US005121684A

United States Patent [19]

Bielfeldt

[11] Patent Number: 5,121,684

[45] Date of Patent: Jun. 16, 1992

[54] CONTINUOUSLY WORKING PRESS HAVING AN INTRODUCTION DEVICE FOR ALIGNING ROLLING RODS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 535,199

[22] Filed: Jun. 8, 1990

[30] Foreign Application Priority Data

Jun. 8, 1989 [DE] Fed. Rep. of Germany ..... 3918755

[51] Int. Cl.[5] ..... B30B 5/06; B30B 15/34

[52] U.S. Cl. ..... 100/38; 100/41; 100/93 P; 100/154; 156/583.5; 198/626.6; 198/833; 425/371

[58] Field of Search ..... 100/35, 41, 93 P, 93 RP, 100/151, 152, 154, 38; 156/583.5, 555; 198/626.4, 626.6, 833; 264/120; 425/371, 335

[56] References Cited

U.S. PATENT DOCUMENTS

| | | | |
|---|---|---|---|
| 2,075,735 | 3/1937 | Loomis | 425/371 |
| 2,142,932 | 1/1939 | Beard | 100/154 X |
| 3,981,666 | 9/1976 | Wadman | 425/371 |
| 4,375,350 | 3/1983 | Sato | 425/371 |
| 4,480,978 | 11/1984 | Gerhardt | 425/371 |
| 4,517,148 | 5/1985 | Churchland | 425/371 X |
| 4,613,293 | 9/1986 | Gerhardt | 425/371 |
| 4,621,999 | 11/1986 | Gerhardt | 425/371 |
| 4,647,417 | 3/1987 | Böttger et al. | 100/154 X |
| 4,718,843 | 1/1988 | Carlsson et al. | 100/93 RP X |
| 4,923,384 | 5/1990 | Gerhardt | 100/93 RP X |

FOREIGN PATENT DOCUMENTS

| | | | |
|---|---|---|---|
| 525788 | 6/1956 | Belgium | 100/154 |
| 2037442 | 2/1972 | Fed. Rep. of Germany . | |
| 2222419 | 11/1972 | Fed. Rep. of Germany . | |
| 2343427 | 3/1975 | Fed. Rep. of Germany . | |
| 3133792 | 7/1985 | Fed. Rep. of Germany . | |
| 1151500 | 5/1969 | United Kingdom . | |

*Primary Examiner*—Harvey C. Hornsby
*Assistant Examiner*—Stephen F. Gerrity
*Attorney, Agent, or Firm*—Foley & Lardner

[57] ABSTRACT

A method and apparatus for pressing an article includes a press arm and a press platen defining a pressing region positioned therebetween. First and second endless steel bands transmit a pressing force to an article to be pressed and draw the article through the press. A plurality of co-rotating rolling rods support the steel bands as they travel through the press. The rolling rods are introduced to an entry region of the press orthogonally relative to a longitudinal center of the press. First and second resilient pressure holding plates located in the entry region adjacent the press platen and the press ram, respectively, impose a pressure on the rolling rods that progressively increases as the rolling rods pass through the entry region.

20 Claims, 3 Drawing Sheets

CONTINUOUSLY WORKING PRESS HAVING AN INTRODUCTION DEVICE FOR ALIGNING ROLLING RODS

BACKGROUND OF THE INVENTION

1. Field of the Invention

The invention relates to a continuously working press, and, more particularly, to a continuously working press for the production of chipboards, fiberboard, plastic boards, plywood boards or the like.

2. Discussion of the Related Art

Such presses typically include flexible, endless steel bands which transmit the pressing force and draw the article to be pressed through the press and which are supported with an adjustable press nip against abutments of press platen and press ram via co-rotating rolling rods guided with their axes transverse relative to the running direction of the band. The rolling rods are typically introduced in the entry region orthogonally relative to the longitudinal center of the press and into the pressing region by plate-link chains and by introduction devices.

A press of the type mentioned is described in German patent specification No. 3,152,911. In this press, the introduction device consists of a plurality of rotating roller chains which are distributed at a distance from one another over the width of the sheet-steel press bands, the rolling rods being mounted in the entry region in the manner of rolling bearings on the rollers of the roller chains.

A disadvantage of this rolling-rod introduction device is that, when there is a permanent positive alignment of the rolling rods at an exact distance from one another, an overloading of the roller chains and consequently a differing extension of the chain plate links occur. This in turn means that the rolling rods are no longer at an exact distance from one another on entry into the high-pressure region, which could result in a run-on of the rolling rods and their destruction. Furthermore, the directing forces of the rollers acting permanently on the rolling rods cause a partial wear on the rolling rods and in the joints of the roller chains. The wear in the joints results in a greater play. But, because of this, an exact alignment of the rolling rods at a predetermined spacing is lost once again, since, with increasing age, the roller chains have a different pitch division. Therefore, the alignment of the rolling rods with an exact gap spacing depends on the counterpressure arising from the article to be pressed.

Another disadvantage is that the roller chains cool during the return outside the heating plates. At different temperatures between the two outer chain introduction points on the left and right sides of the press, an orthogonal entry is then disrupted by different chain extensions. Moreover, in the positive introduction region beginning at the start of the entry tangent, the roller chains experience an elongation as a result of an increased temperature, thereby partially necessitating a higher rolling-rod speed in this region than the usual speed of 0.5 x the steel band speed. This partial acceleration likewise leads to wear on the roller chains and rolling rods, creating a further adverse effect on the surface of the pressed boards from striation.

SUMMARY OF THE INVENTION

An object of the invention is to provide a continuously working press, in which the introduction devices do not exert any permanent and identical directing forces in the entry region of the press platen and press ram, but instead build up an adjustable and controllable pressure mosaic, and in which the introduction device gives the rolling rods a sufficient degree of freedom for axial self-stabilization.

According to one aspect of the invention, the press includes a press ram and a press platen defining an adjustable press nip located in a pressing region positioned therebetween and first and second endless steel bands which transmit a pressing force to an article to be pressed and draw the article through the press. Driving drums and deflection drums guide the first and second endless steel bands round the press platen and the press ram, respectively, and a plurality of co-rotating rolling rods support the steel bands as they travel through the press. The rolling rods have axes of rotation transverse to a running direction of the steel bands. In addition, plate link chains and introduction devices guide the rolling rods orthogonally relative to a longitudinal center of the press through an entry region of the press and through the pressing region. First and second resilient pressure holding plates located in the entry region adjacent the press platen and the press ram, respectively, impose a progressively increasing pressure on the rolling rods as the rolling rods pass through the entry region.

In accordance with another aspect of the invention, the first and second pressure holding plates extend the width of the entry region, and a plurality of controllable adjusting members cooperating with each of the pressure holding plates resiliently support the respective plate along its entire width. Each of the adjusting members may be a hydraulic adjusting member. The adjusting members may be arranged so as to impose a force along the widths of the pressure holding plates that decreases from the lateral edges inward. This force distribution imposes a non-positive clamping force on the rolling rods that decreases from the ends of the rods towards the middle thereof.

In accordance with another aspect of the invention, the press includes heating means for heating the entire adjustment device to a uniform temperature.

Another object of the invention is to provide a method of aligning rolling rods of a continuously working press as they are conveyed through the press, the press comprising a press platen and a pressing ram defining a pressing region therebetween, and a pair of endless bands which are supported by the rolling rods and which draw an article through the press and transmit a pressing force to the article.

In accordance with one aspect of the invention, the method includes the steps of introducing the rolling rods into an entry region of the press orthogonally relative to a longitudinal center of the press, and then applying a force along the lengths of the rolling rods that progressively increases as the rolling rods travel through the entry region. Distributing the forces on the rolling rods in this manner imposes a non-positive clamping force on the rolling rods. As a final step, the rolling rods are conveyed through the pressing region of the press.

In accordance with another aspect of the invention, the force imposed on the rolling rods is initially greater at the ends of the rods than at the centers thereof.

In accordance with yet another aspect of the invention, the alignment of the rolling rods is performed by an alignment device, and the method includes the further step of heating the entire alignment device to a uniform temperature.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

An exemplary embodiment of the invention is described in detail below and illustrated in the accompanying drawings, wherein.

DETAILED DESCRIPTION OF THE PREFERRED EMBODIMENTS

The advantages of the invention are particularly that the alignment of the rolling rods with a uniform mutual gap spacing, absolutely straight and exactly at right angles to the working direction, is guaranteed by pressure holding plates which are designed with a metered and controlled non-positive connection and with an increasing directing force and which are arranged between the entry tangent and the high-pressure zone. The increasing directing force is imposed via adjustable spring elements or hydraulic adjusting members. This simple introduction device ensures that the gap spacing imposed on the rolling rods by the introduction gearwheels and their exact right-angled run from the entry tangent into the high-pressure region no longer change. Consequently, a constraint-free axial self-stabilization of the rolling rods is also achieved:

1. because the rolling rods are free of constraint in terms of thermal expansion in the non-positive connection of controlled force, and
2. because different pressure topographies under uncontrolled deformations of the steel bands do not have a negative effect on the rolling rods because of the resilient pressure holding plates.

From the entry tangent, the rolling rods are introduced by the introduction gearwheels into a sprung pressure device with an increasing pressure trend, i.e., they are introduced with a metered and controlled non-positive connection. At the same time, the controlled pressure trend is controlled via the adjustable spring elements or hydraulic adjusting members in such a way that, in the entry tangent, the controlled clamping force will initially mainly act only on the outside, with the middle pressure force=0, via the flexible pressure holding plate.

Figure 1:
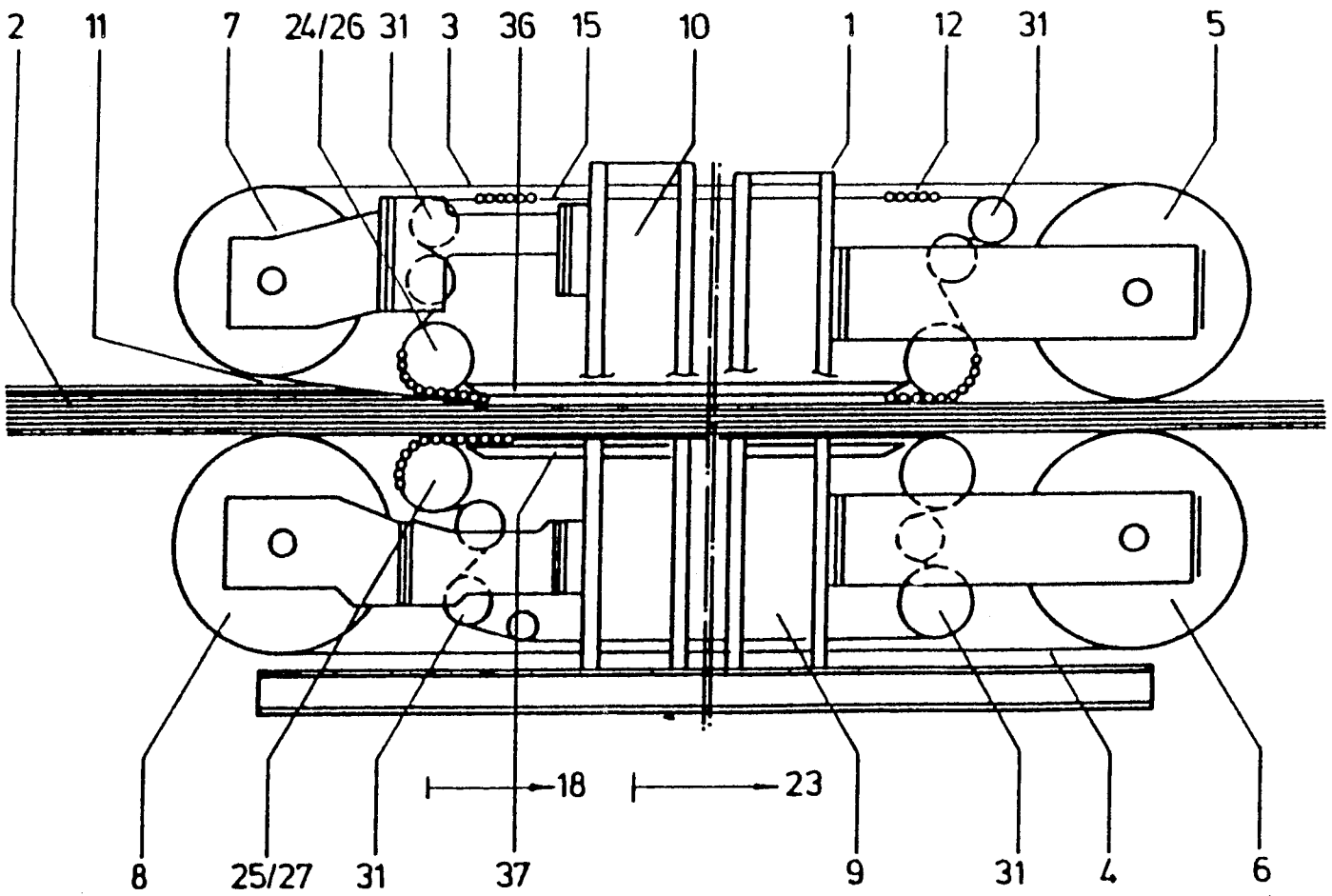
FIG. 1 shows a side view of a press according to the invention in a diagrammatic representation.

With reference to FIG. 1, the continuously working press 1 consists of a press platen 9, a movable press ram 10 and tension columns (not shown) connecting these. To adjust the press nip 11, the press ram 10 is moved up and down by hydraulic piston/cylinder arrangements (not shown) and is then retained in the selected position. Steel bands 3 and 4 are respectively guided round the press platen 9 and the press ram 10 via driving drums 5, 6 and deflecting drums 7, 8.

To prevent thermal stresses and therefore different extensions, the entire system of the entry alignment device is maintained at a uniform operating temperature by providing a heating means, which in this case comprises heating plates 36 and 37 attached to the press platen 9, the press ram 10 and the rotating steel bands 3 and 4.

To reduce the friction between the heating plates 36 and 37, a likewise rotating rolling-rod carpet formed from rolling rods 12 is provided in each case. The rolling rods 12, the axes of which extend transversely relative to the band run-through direction, i.e., the direction of motion of the bands, are joined together on the two longitudinal sides of the press 1 in plate-link chains 15 with a predetermined pitch division. The rolling rods 12 roll between the heating plates 36 and 37 of the press ram 10 and the press platen 9, on the one hand, and the steel bands 3 and 4, on the other hand, and thereby help the bands 3 and 4 take up the article 2 to be pressed and to guide it through the press 1.

Figure 2:
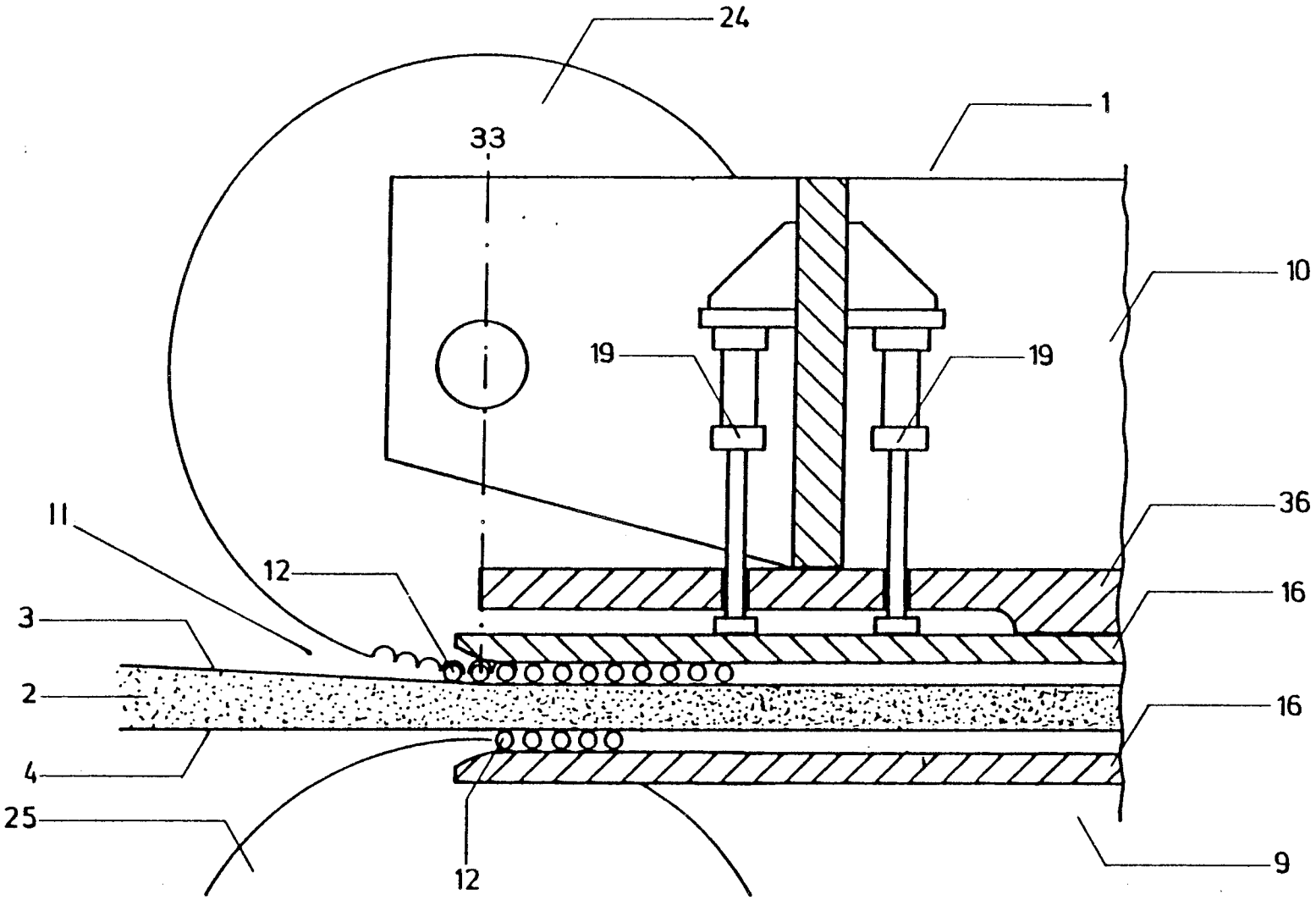
FIG. 2 shows a rolling-rod introduction device in the entry region.
Figure 3:
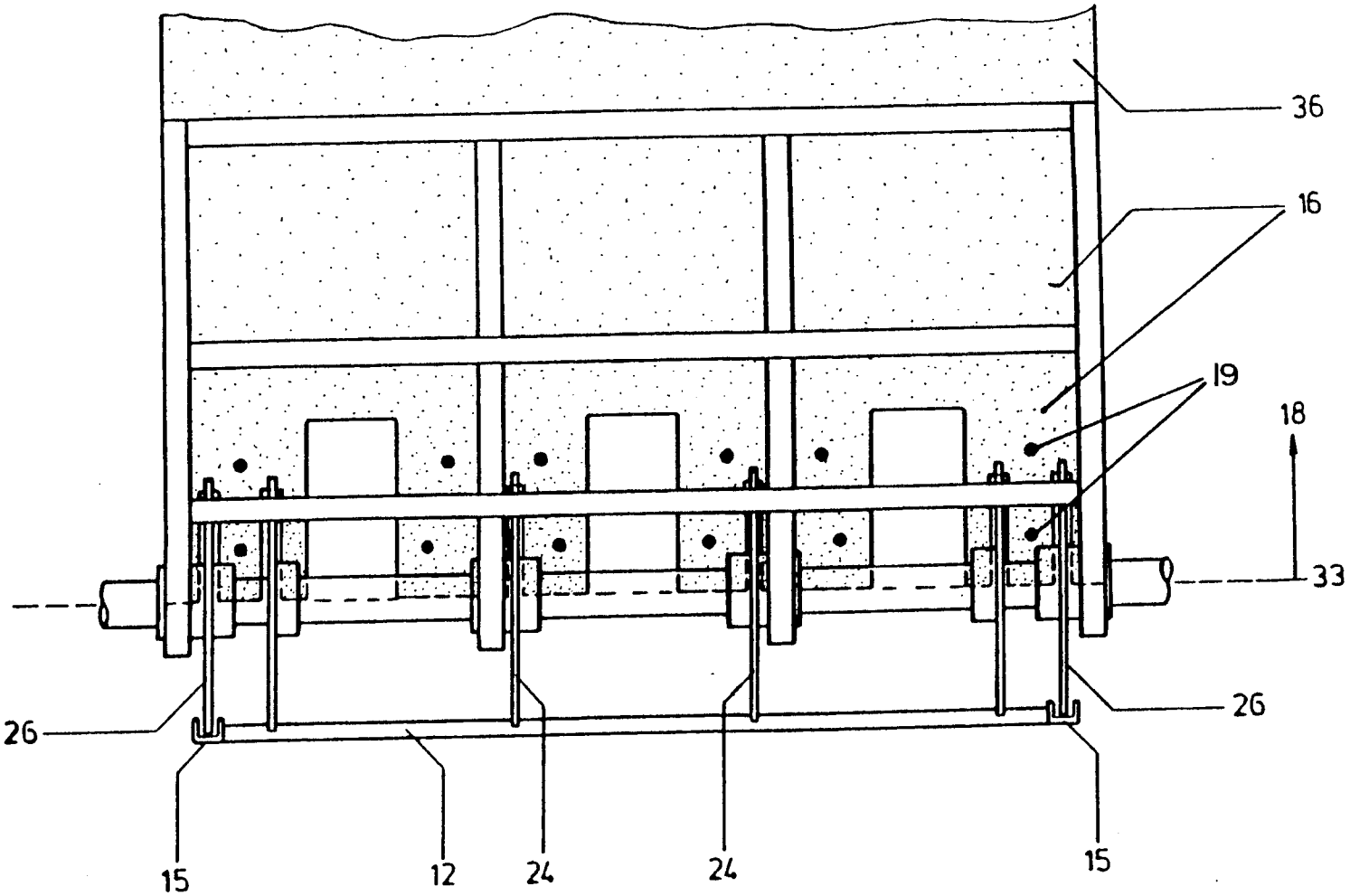
FIG. 3 shows the top view of the rolling-rod introduction device according to FIG. 2.

As illustrated in FIGS. 1 to 3, that the rolling rods 12 are introduced positively and nonpositively into the horizontal press plane by introduction gearwheels 24 and 25 and the plate-link chains 15 are introduced by two entry gearwheels 26 and 27 arranged laterally relative to the entry heating plate. The introduction gearwheels 24 and 25 are fastened to the press ram 10 and the press platen 9 respectively, and the entry gearwheels 26 and 27 are fastened to the press ram 10 and the press platen 9 respectively, each on an axle (FIG. 3). Reference numeral 18 denotes the start of the entry region of the rolling rods 12 into the press zone, and numeral 23 denotes the end and the start, i.e. the length, of the high-pressure zone, whilst numeral 33 designates the entry tangent of the introduction gearwheels 24 and 25 and consequently the point when the rolling rods 12 first make contact with the steel bands 3 and 4 of the press platen 9 and press ram 10. The rolling-rod rotation in the press platen 9 and press ram takes place via the deflecting rollers 31.

As illustrated in FIGS. 2 and 3, the rolling rods 12 are introduced by the introduction gearwheels 24 and 25 from the entry tangent into a sprung pressure device with an increasing pressure trend into the pressing region. The resilient pressure device consists in this case of a resilient pressure holding plate 16 which acts on the rolling rods 12 over their entire length by means of adjustable spring elements (not shown) or by hydraulically controllable adjusting members 19. It can thus be seen that the resilient pressure holding plates impose a progressively increasing pressure on the rods 12 as they move through the entry region 18 towards the pressing region 23. From the entry tangent 33, by means of the resilient pressure holding plates 16, the rolling rods 12 also initially experience a permanent non-positive clamping pressure taking place with decreasing pressure from the outsides of the rods inwards. To assist the clamping pressure to act initially only on the outsides of the rolling rods, the flexible pressure holding plate 16 can have a parabolic free cutout centrally, so that there cannot even be any insignificant force effect in the middle of the rolling rods 12. These measures are decisive for an orthogonal guidance of the rolling rods 12 in the entry region 18 and their orthogonal transfer at an exact spacing into the high-pressure pressing region 23. Of course, the resilient pressure device 16 and 19 is also provided in the press platen 9, even though it is shown only incompletely in FIG. 2.

What is claimed is:

1. A continuously working press comprising:

(A) a press ram and a press platen defining an adjustable press nip located in a pressing region positioned therebetween;

(B) first and second endless steel bands adapted to transmit a pressing force to an article to be pressed and to draw said article through said press;

(C) driving drums and deflection drums adapted to guide said first and second endless steel bands around said press platen and said press ram, respectively;

(D) a plurality of co-rotating rolling rods adapted to support said steel bands as they travel through said press, said rolling rods having axes of rotation transverse to a running direction of said steel bands;

(E) plate link chains and introduction devices adapted to guide said rolling rods orthogonally relative to a longitudinal center of said press through an entry region of said press and through said pressing region;

(F) first and second resilient pressure holding plates located in said entry region adjacent said press platen and said press ram, respectively; and (G) means for applying a force to said holding plates for imposing a progressively increasing pressure on said rolling rods as said rolling rods pass through said entry region.

2. The press of claim 1, wherein said first and second pressure holding plates extend the width of said entry region, and said means for applying a force to said holding plates comprises a plurality of controllable adjusting members cooperating with each of said pressure holding plates and adapted to resiliently support the respective plate along its entire width.

3. The press of claim 2, wherein each of said adjusting members comprises a hydraulic adjusting member.

4. The press of claim 2, wherein each of said adjusting members comprises an adjustable spring element.

5. The press of claim 2, further comprising heating means for heating said first and second pressure holding plates to a uniform temperature.

6. The press of claim 1, further comprising heating means for heating said first and second pressure holding plates to a uniform temperature.

7. A press, comprising:

(A) a press ram and a press platen facing one another to define a pressing region therebetween;

(B) band means for drawing an article to be pressed through said press and for transmitting a pressing force to said article;

(C) a plurality of rolling rods adapted to support each of said band means as it draws said article through an entry region of said press and through said pressing region; and (D) an entry alignment device including means for guiding said rolling rods orthogonally relative to a longitudinal center of said press through an entry tangent, through said entry region, and into said pressing region, first and second resilient pressure holding plates located in said entry region adjacent said press platen and said press ram, respectively; and (E) means for applying a force to said holding plates for imposing a progressively increasing pressure on said rolling rods as said rolling rods pass through said entry region.

8. The press of claim 7, wherein said first and second pressure holding plates extend the width of said pressing region, and said means for applying a force to said holding plates comprises a plurality of controllable adjusting means for resiliently supporting said first and second pressure holding plates along their entire widths.

9. The press of claim 8, wherein each of said adjusting means comprises a hydraulic adjusting member.

10. The press of claim 7, further comprising heating means for heating said entry alignment device to a uniform temperature.

11. A method of aligning rolling rods of a continuously working press as they are conveyed through said press, said press comprising a press platen and a pressing ram defining a pressing region therebetween, and a pair of endless bands which are supported by said rolling rods and which draw an article through said press and transmit a pressing force to said article, said method comprising the steps of:

(A) introducing said rolling rods into an entry region of said press orthogonally relative to a longitudinal center of said press; then (B) applying a force to first and second resilient pressure holding plates via a force applying device, said first and second pressure holding plates being locate din said entry region adjacent said press platen and said press ram, respectively; said force imposing a progressively increasing pressure on said rolling rods as said rolling rods travel through said entry region, whereby a non-positive clamping force is imposed on said rolling rods; and then (C) conveying said rolling rods through said pressing region.

12. The method of claim 11, wherein the force imposed on said rolling rods is adjustable.

13. The method of claim 12, wherein the alignment of said rolling rods is performed by an alignment device, and further comprising the step of heating the entire alignment device to a uniform temperature.

14. A continuously working press comprising:

(A) a press ram and a press platen defining an adjustable press nip located in a pressing region positioned therebetween;

(B) first and second endless steel bands adapted to transmit a pressing force to an article to be pressed and to draw said article through said press;

(C) driving drums and deflection drums adapted to guide said first and second endless steel bands around said press platen and said press ram, respectively;

(D) a plurality of co-rotating rolling rods adapted to support said steel bands as they travel through said press, said rolling rods having axes of rotation transverse to a running direction of said steel bands;

(E) plate link chains and introduction devices adapted to guide said rolling rods orthogonally relative to a longitudinal center of said press through an entry region of said press and through said pressing region;

(F) first and second heating plates connected to the press ram and press platen, respectively;

(G) first and second resilient pressure holding plates connected to said first and second heating plates, respectively, and located in said entry region adjacent said press platen and said press ram, respectively; and (H) means for applying a force to said holding plates for imposing a progressively increasing pressure on said rolling rods as said rolling rods pass through said entry region, said force applying means comprising a plurality of controllable adjusting members cooperating with each of said pressure holding plates and adapted to resiliently support the respective plate along its entire width.

15. A continuously working press comprising:

(A) a press ram and a press platen defining an adjustable press nip located in a pressing region positioned therebetween;

(B) first and second endless steel bands adapted to transmit a pressing force to an article to be pressed and to draw said article through said press;

(C) driving drums and deflection drums adapted to guide said first and second endless steel bands around said press platen and said press ram, respectively;

(D) a plurality of co-rotating rolling rods adapted to support said steel bands as they travel through said press, said rolling rods having axes of rotation transverse to a running direction of said steel bands;

(E) plate link chains and introduction devices adapted to guide said rolling rods orthogonally relative to a longitudinal center of said press through an entry region of said press and through said pressing region;

(F) first and second resilient pressure holding plates located in said entry region adjacent said press platen and said press ram, respectively, and adapted to impose a progressively increasing pressure on said rolling rods as said rolling rods pass through said entry region, wherein said first and second holding plates extend the width of said entry region; and (G) a plurality of controllable adjusting members cooperating with each of said pressure holding plates and adapted to resiliently support the respective plate along its entire width;

wherein said adjusting members are arranged so as to impose a force along the widths of said pressure holding plates that decreases from lateral edges inward, whereby a non-positive clamping force is imposed on said rolling rods that decreases from the ends of each of said rods towards a middle thereof.

16. The press of claim 15, further comprising heating means for heating said first and second pressure holding plates to a uniform temperature.

17. A press, comprising:

(A) a press ram and a press platen facing one another to define a pressing region therebetween;

(B) band means for drawing an article to be pressed through said press and for transmitting a pressing force to said article;

(C) a plurality of rolling rods adapted to support each of said band means as it draws said article through an entry region of said press and through said pressing region; and (D) an entry alignment device including means for guiding said rolling rods orthogonally relative to a longitudinal center of said press through an entry tangent, through said entry region, and into said pressing region, first and second resilient pressure holding plates extending the width of said pressing region and located in said entry region adjacent said press platen and said press ram, respectively, and adapted to impose a progressively increasing pressure on said rolling rods as said rolling rods pass through said entry region; and (E) a plurality of controllable adjusting means for resiliently supporting said first and second pressure holding plates along their entire widths, each of said adjusting means comprising a hydraulic adjusting member;

wherein said adjusting means impose a force along the widths of said pressure holding plates that decreases from lateral edges inward, whereby a non-positive clamping force is imposed on said rolling rods that decreases from the ends of each of said rods towards a middle thereof.

18. The press of claim 17, further comprising heating means for heating said entry alignment device to a uniform temperature.

19. The press of claim 18, wherein said heating means comprises a pair of heating plates.

20. A method of aligning rolling rods of a continuously working press as they are conveyed through said press, said press comprising a press platen and a pressing ram defining a pressing region therebetween, and a pair of endless bands which are supported by said rolling rods and which draw an article through said press and transmit a pressing force to said article, said method comprising the steps of:

(A) introducing said rolling rods into an entry region of said press orthogonally relative to a longitudinal center of said press; then (B) applying a force along the lengths of said rolling rods that progressively increases as said rolling rods travel through said entry region and which is initially greater at the ends of said rods than at the centers thereof, whereby a non-positive clamping force is imposed on said rolling rods; and then (C) conveying said rolling rods through said pressing region.

* * * * *